US005797383A

United States Patent [19]

Matsubara et al.

[11] Patent Number: 5,797,383

[45] Date of Patent: Aug. 25, 1998

[54] DUAL POLARITY TYPE IGNITION SYSTEM FOR A SPARK PLUG GROUP

[75] Inventors: Yoshihiro Matsubara; Katsutoshi Nakayama, both of Nagoya, Japan

[73] Assignee: NGK Spark Plug Co., Ltd., Nagoya, Japan

[21] Appl. No.: 834,525

[22] Filed: Apr. 4, 1997

[30] Foreign Application Priority Data

Apr. 5, 1996 [JP] Japan ..... 8-84270

[51] Int. Cl.[6] ..... F02P 29/04; F02P 1/00

[52] U.S. Cl. ..... 123/594; 123/169 EL; 123/169 MG

[58] Field of Search ..... 123/594, 169 EL, 123/169 G, 169 R, 608, 169 MG; 313/140, 141, 123

[56] References Cited

U.S. PATENT DOCUMENTS

| | | | |
|---|---|---|---|
| 3,908,145 | 9/1975 | Kubo | 313/123 |
| 4,004,562 | 1/1977 | Rado et al. | 123/169 MG |
| 4,730,582 | 3/1988 | Lindsay | 123/169 EL |
| 4,901,688 | 2/1990 | Kashiwara et al. | 123/169 EL |
| 4,989,557 | 2/1991 | Penney | 123/169 EL |
| 5,581,145 | 12/1996 | Kato et al. | 313/141 |

FOREIGN PATENT DOCUMENTS 07 130454 5/1995 Japan ..... H01T 13/32

*Primary Examiner*—Raymond A. Nelli

*Attorney, Agent, or Firm*—Sughrue, Mion, Zinn, Macpeak & Seas, PLLC

[57] ABSTRACT

In a dual polarity type ignition system for a spark plug group, a cylindrical metal shell is provided in which an insulator is provided. The insulator has an axial bore in which a center electrode is provided whose front end has a first noble metal tip. A ground electrode extends from a front end of the metal shell and having a second noble metal tip to form a spark discharge gap between the first noble metal tip and the second noble metal tip. The group of the spark plugs is divided into two groups, one is a positive polarity spark plug group in which a positive high voltage is applied to the center electrode, and the other group is a negative polarity spark plug group in which a negative high voltage is applied to the center electrode. The first noble metal tip of the center electrode of the positive polarity spark plug group is dimensionally smaller than the first noble metal tip of the center electrode of the negative polarity spark plug group. The second noble metal tip of the ground electrode of the negative polarity spark plug group is dimensionally smaller than the second noble metal tip of the ground electrode of the positive polarity spark plug group.

8 Claims, 10 Drawing Sheets

DUAL POLARITY TYPE IGNITION SYSTEM FOR A SPARK PLUG GROUP

BACKGROUND OF THE INVENTION

1. Field of the Invention

The invention relates to a dual polarity type ignition system for a spark plug group in which a noble metal tip is secured to an electrode to advantageously improve a spark erosion resistance property, and particularly relates to a spark plug which is energized with a dual polarity type ignition device as a power source.

2. Description of Prior Art

In a dual polarity type distributorless ignition device (DLI), a row of spark plugs are categorically divided into two groups, one is a group in which a terminal is connected to a positive high voltage terminal of a secondary coil in an ignition coil, while the other is a group in which the terminal is connected to a negative high voltage terminal of the secondary coil in the ignition coil. In each of the groups of the spark plugs, spark plugs having the same structure have been incorporated into the ignition device.

On the other hand, a Pt-related noble metal tip has been used on a firing portion of a center and ground electrode to exhibit a spark erosion resistant property. In a platinum spark plug in which the Pt-related metal tip is provided, it is possible to prevent a spark gap from inadvertently increasing due to the spattering action in which the firing portion would be spark eroded so that a part of the firing portion is gradually dissipated. An experimental test result showed that the durability in terms of the spark erosion had been improved from approx. 30000 km to 100000 km. However, the Pt-related noble metal is generally very expensive.

Upon incoporating the platinum spark plug into the dual polarity type distributorless ignition device (DLI), the same dimensional Pt-related metal tip has been used indiscriminately regardless of whether the spark plug is connected to a negative or positive polarity side.

In the platinum spark plug incoporated into distributorless ignition device (DLI), a ground electrode of the spark plug group in which the positive high voltage is applied to the center electrode, is spark eroded faster than that in which the negative high voltage is applied to a center electrode. The center electrode of the spark plug group in which the negative high voltage is applied to a center electrode, is spark eroded faster than that in which the positive high voltage is applied to the center electrode.

Despite the fact that the Pt-related metal tip is unacceptably eroded at an end of the serviceable period in the ground electrode of the spark plug group in which the positive high voltage is applied to the center electrode, the Pt-related metal tip is only slightly eroded in the ground electrode of the other spark plug group in which the negative high voltage is applied to the center electrode.

The same is true in spite of the Pt-related metal tip being unacceptably eroded in the center electrode of the spark plug group in which the negative high voltage is applied to the center electrode, the Pt-related metal tip is only slightly eroded in the center electrode of the other spark plug group in which the positive high voltage is applied to the center electrode.

For this reason, the platinum spark plug is wastefully replaced with a new one although the expensive Pt-related metal tip sufficiently remains on the center or ground electrode in the specified spark plug group.

Therefore it is a main object of the present invention to provide a dual polarity type ignition system for a spark plug group which is capable of leveling off the spark erosion of a noble metal tip irrespective of whether a negative or positive high voltage is applied to a center electrode, thereby insuring an economical use of the expensive noble metal without sacrificing a good spark erosion resistant property.

SUMMARY OF THE INVENTION

According to the invention of a dual polarity type ignition system, a first noble metal tip of a center electrode of a spark plug (positive polarity group) to which a positive high voltage is applied, is spark eroded slower than that of a spark plug (negative polarity group) to which a negative high voltage is applied. On the other hand, a second noble metal tip of a ground electrode of the spark plug (negative polarity group) in which the negative high voltage is applied to the center electrode, is spark eroded slower than that of a spark plug (positive polarity group) in which the positive high voltage is applied to the center electrode.

In view the above, it is found that the spark erosion resistant property is not affected substantially by making the first noble metal tip dimensionally smaller in which the positive high voltage is applied to the center electrode of the spark plug (positive polarity group) than that of a spark plug (negative polarity group) in which the negative high voltage is applied to the center electrode.

The same is true when making the second noble metal tip of the ground electrode of that of a spark plug (negative polarity group) dimensionally smaller in which the negative high voltage is applied to the center electrode than that of a spark plug (positive polarity group) in which the positive high voltage is applied to the center electrode.

This makes it possible to reduce an amount of the noble metal in which the electrode is slowly eroded, and thus decreases an entire amount of the noble metal used for the spark plug so as to contribute to cost reduction of the spark plug and the ignition system without losing a good spark erosion resistance.

This holds true when devoid of the second noble metal tip of the ground electrode of the spark plug in which the negative high voltage is applied to the center electrode.

According to another aspect of the invention of a dual polarity type ignition system, a first noble metal alloy tip of a center electrode of a spark plug (positive polarity group) to which a positive high voltage is applied, is spark eroded slower than that of a spark plug (negative polarity group) to which a negative high voltage is applied. On the other hand, a second noble alloy metal tip of a spark plug in which the negative high voltage is applied to the center electrode, is spark eroded slower than that of a spark plug to which the positive high voltage is applied to the center electrode.

In view the above, it is found that the spark erosion resistant property is not affected substantially by making a noble metal component of the first noble metal alloy tip smaller in which the positive high voltage is applied to the center electrode than that of a spark plug in which the negative high voltage is applied to the center electrode.

The same is true when making a noble metal component of the second noble metal alloy tip of the ground electrode smaller in which the negative high voltage is applied to the center electrode than that of a spark plug in which the positive high voltage is applied to the center electrode.

This makes it possible to reduce the noble metal component of the noble metal alloy tip in which the electrode is eroded slower, and thus decreases an entire amount of the noble metal used for the spark plug so as to contribute to cost reduction of the spark plug and the ignition system without losing a good spark erosion resistance.

According to another aspect of the invention of a dual polarity type ignition system, when used by combining a mono-gap type spark plug and a multi-gap type spark plug, a negative high voltage is applied to the center electrode in the mono-gap type spark plug, while a positive high voltage is applied to the center electrode in the multi-gap type spark plug.

In the multi-gap type spark plug, a noble metal tip or a noble metal alloy tip is secured to an elevational side of a front end of the center electrode to which the positive high voltage is applied. In this instance, the noble metal tip provided on the ground electrodes can be omitted because the spark erosion is shared by the pluralistic ground electrodes.

In the mono-gap type spark plug, a noble metal tip is provided preferably on both the center electrode and the parallel type ground electrode to reduce the spark erosion of the center and ground electrode to which a negative and positive high voltage is in turn applied.

This makes it possible to decrease an entire amount of the noble metal used for the spark plug so as to contribute to cost reduction without losing a good spark erosion resistance.

According to still another aspect of the invention of a dual polarity type ignition system, a first noble metal tip of a center electrode of a spark plug to which a positive high voltage is applied, is spark eroded slower than a second noble metal tip of a ground electrode, and a second noble metal tip of a spark plug to which a positive high voltage is applied to a center electrode, is spark eroded slower than a first noble metal tip of a center electrode.

This makes it possible to decrease an amount of the noble metal tip of the center electrode of the spark plug to which the high positive voltage is applied more than that of the ground electrode without losing a good spark erosion resistant property. This holds true when no noble metal tip is provided on the center electrode of the spark plug in which the high positive voltage is applied to the center electrode.

This also makes it possible to decrease an amount of the noble metal tip of the ground electrode of the spark plug in which the high negative voltage is applied to the center electrode more than that of the center electrode without losing a good spark erosion resistant property. This holds true when no noble metal tip is provided on the ground electrode of the spark plug in which the high negative voltage is applied to the center electrode.

With the smaller amount or no amount of the noble metal of the electrode which is spark eroded slowly, this makes it possible to decrease an entire amount of the noble metal so as to contribute to cost reduction of the spark plug and the ignition system without losing a good spark erosion resistance.

According to another aspect of the invention of a dual polarity type ignition system, a first noble metal alloy tip of a center electrode of a spark plug to which a positive high voltage is applied is spark eroded slower than a second noble metal alloy tip of a ground electrode, and a second noble alloy metal tip of a spark plug to which a positive high voltage is applied to a center electrode is spark eroded slower than a first noble metal tip of a center electrode.

This makes it possible to decrease a noble metal component of the noble metal alloy tip of the center electrode of the spark plug in which the high positive voltage is applied to the center electrode more than that of the ground electrode without losing a good spark erosion resistant property. This holds true when no noble metal alloy tip is provided on the center electrode of the spark plug to which the high positive voltage is applied.

This also makes it possible to decrease an amount of the noble metal component of the ground electrode of the spark plug in which the high negative voltage is applied to the center electrode more than that of the center electrode without losing a good spark erosion resistant property. This holds true when no noble metal alloy tip is provided on the ground electrode of the spark plug in which the high negative voltage is applied to the center electrode.

With the smaller amount or no amount of noble metal of the electrode which is spark eroded slowly, it is possible to decrease an entire amount of the noble metal so as to contribute to cost reduction of the spark plug and the ignition system without losing a good spark erosion resistance.

According to still another aspect of the invention of a dual polarity type ignition system, it is possible to eliminate or reduce an amount of a noble metal tip of a center electrode of a spark plug to which a positive high voltage is applied more than that of the ground electrode without losing a good spark erosion resistant property.

On the other hand, it is possible to eliminate or reduce an amount of a noble metal tip of a ground electrode of a spark plug to which a negative high voltage is applied to the center electrode more than that of the ground electrode of the spark plug to which a high positive voltage is applied to the center electrode without losing a good spark erosion resistant property.

With the smaller amount or no amount of noble metal of the electrode which is spark eroded slowly, it is possible to decrease an entire amount of the noble metal so as to contribute to cost reduction of the spark plug and the ignition system without losing a good spark erosion resistance.

According to still another aspect of the invention of a dual polarity type ignition system, it is possible to eliminate or reduce a noble metal component of the noble metal alloy tip of a center electrode of a spark plug to which a positive high voltage is applied more than that of the center electrode of a spark plug to which a high negative voltage is applied without losing a good spark erosion resistant property.

On the other hand, it is possible to eliminate or reduce a noble metal component of the noble metal alloy tip of a ground electrode of a spark plug to which a negative high voltage is applied to the center electrode more than that of the ground electrode of a spark plug in which a high positive voltage is applied to the center electrode without losing a good spark erosion resistant property.

With the smaller amount or no amount of noble metal of the electrode, it is possible to decrease an entire amount of the noble metal so as to contribute to cost reduction of the spark plug and the ignition system without losing a good spark erosion resistance.

According to another aspect of the invention of a dual polarity type ignition system, it is possible to eliminate or reduce a noble metal component of the noble metal alloy tip (or an amount of the noble metal tip) of a center electrode of a spark plug to which a positive high voltage is applied more than that of the center electrode to which a negative high voltage is applied without losing a good spark erosion resistant property.

On the other hand, it is possible to eliminate or reduce a noble metal component of the noble metal alloy tip (or an amount of the noble metal tip) of a ground electrode of a spark plug in which a negative high voltage is applied to the center electrode more than that of the ground electrode of a spark plug in which a positive high voltage is applied to the center electrode without losing a good spark erosion resistant property.

With the smaller amount or no amount of noble metal tip of the electrode, it is possible to decrease an entire amount of the noble metal so as to contribute to cost reduction of the spark plug and the ignition system without losing a good spark erosion resistance.

According to another aspect of the invention of a dual polarity type ignition system, since the center electrode of a multi-gap type spark plug to which a negative high voltage is applied, is spark eroded faster than that to which a positive high voltage is applied, a noble metal tip is provided on the center electrode to which the negative high voltage is applied. In this instance, it is possible to obviate the noble metal tip provided on the ground electrodes because the spark erosion is shared by each of the pluralistic ground electrodes.

This also makes it possible to decrease an entire amount of the noble metal used to the multi-gap type spark plug so as to contribute to cost reduction without losing a good spark erosion resistant property.

DETAILED DESCRIPTION OF PREFERRED EMBODIMENTS OF THE INVENTION

Figure 1:
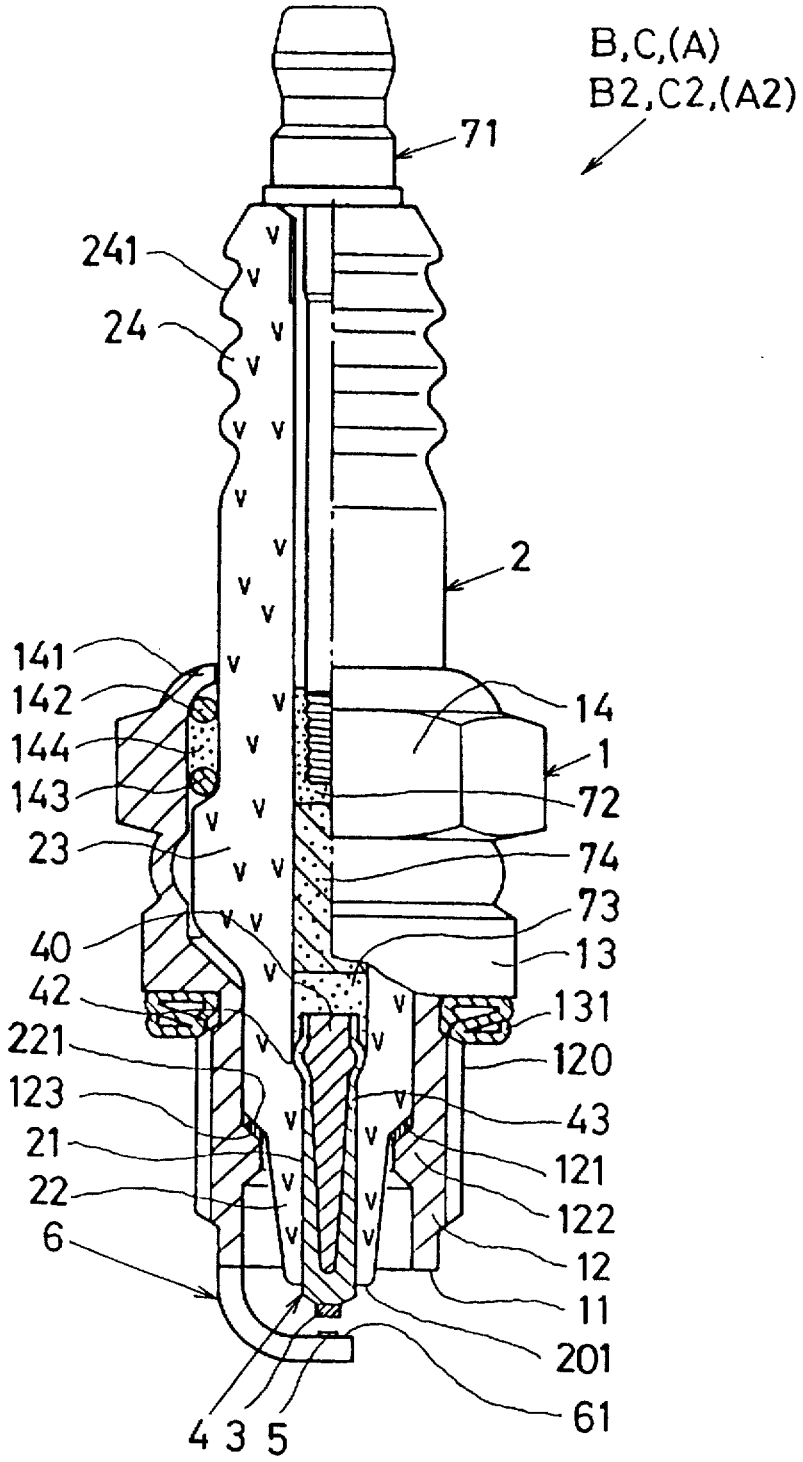
FIG. 1 is a partial cross sectional plan view of a mono-gap type spark plug representing each of embodiments of the present invention.
Figure 2:
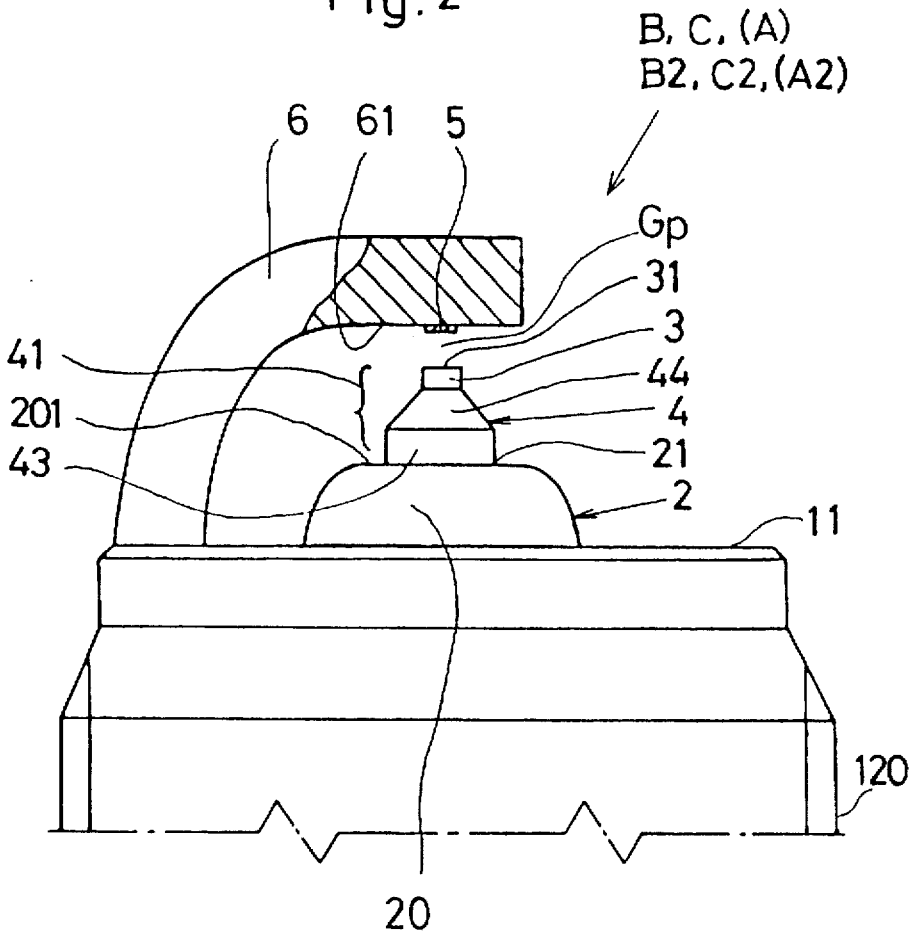
FIG. 2 is an enlarged plan view of a front section of the mono-gap type spark plug.

Referring to FIGS. 1 and 2 which shows a mono-gap type spark plug B (C) having a dual polarity ignition source according to a first embodiment of the invention, the spark plug B (C) has a cylindrical metal shell 1 and an insulator 2 provided in the metal shell 1 in the a front end 20 of the insulator 2 extends from a front end 11 of the metal shell 1. The insulator 2 has an axial bore 21 in which a center electrode 4 is fixedly place so that its front end 41 extends from a front end 201 of the insulator 2. On a front end surface of the center electrode 4, a noble metal tip 3 is fixedly placed as described In detail hereinafter. To the front end 11 of the metal shell 1, a parallel type ground electrode 6 is welded whose front inner side 61 has a noble metal tip 5 to form a spark discharge gap Gp with the noble metal tip 3 of the center electrode 4.

The spark plug B (C)thus structured is to be mounted on a cylinder head of an internal combustion engine (each not shown) via a gasket 131. Numeral 71 shows a terminal electrode, numerals 72, 73 a glass sealant, numeral 74 a resistor element.

For the purpose of convenience, the denotation B represents the mono-gap type spark plug in which a negative high voltage is applied to the center electrode 4 (negative polarity side group), while the denotation C represents the mono-gap type spark plug in which a positive high voltage is applied to the center electrode 4 (positive polarity side group) according to the present and subsequent embodiments of the invention. When using the denotation A, it represents a comparable mono-gap type spark plug which has been used with no consideration taken with respect to adjusting an amount of the noble metal depending on whether the center electrode 4 is in the negative or positive polarity side.

The metal shell 1 is made of a low carbon steel whose outer surface 120 has a threaded portion 12. The metal shell 1 further has a barrel portion 13 and a hexagon 14. The barrel portion has the gasket 131 at the boundary with the threaded portion 12. The hexagon 14 is used to mount the metal shell 1 on the cylinder head by means of a wrench.

The insulator 2 is made from a ceramic material with alumina as a main constituent, and having an insulator nose 22, a diameter-increased portion 23 and a tubular head 24 whose outer surface forms a corrugation portion 241. The insulator nose 22 is surrounded by the threaded portion of the metal shell 1, and the diameter-increased portion 23 is surrounded by the barrel portion 13. The axial bore 21 runs through an entire length of the insulator 2.

The insulator 2 is firmly placed in the metal shell 1 by resting a seat portion 221 on a tapered shoulder portion 123 of a ledge portion 122 of the metal shell 1 via a metallic packing 121. The insulator 2 is stabilized by caulking a rear end fin 141 tightly against the insulator 2 to hermetically seal the insulator 2 by means of O-rings 142, 143 and a talc sealant 144.

The center electrode 4 is made of a nickel-based alloy in which a copper or silver metal core 40 is embedded. The center electrode 4 has a flange portion 42 and an elongation portion 43 and a frusto-cone shaped portion 44 which extends forward from the elongation portion 43. On a front end surface of the frusto-cone shaped portion 44, the noble metal tip 3 is fixedly placed. When referring to the front end of the center electrode 4, it includes a part of the elongation portion 43, the frusto-cone shaped portion 44, and the noble metal tip 3. An extension of the center electrode 4 from the front end 201 of the insulator 2 is 1.5 mm in length, and the spark discharge gap Gp is 1.0 mm in width.

The noble metal tip 3 is made of a Pt-based alloy containing 20% Ir by weight, and having the following dimension.

The noble metal tip 3 measures 0.8 mm in diameter and 0.5 mm in thickess when referring to the mono-gap type spark plug B.

The noble metal tip 3 measures 0.6 mm in diameter and 0.2 mm in thickess when referring to the mono-gap type spark plug C.

The noble metal tip 3 measures 0.8 mm in diameter and 0.5 mm in thickess when referring to the mono-gap type spark plug A.

In the meanwhile, the parallel type ground electrode 6 is formed into L-shaped configuration whose front inner side 61 has the noble metal tip 5 facing a front end surface 31 of the noble metal tip 3 of the center electrode 4.

The noble metal tip 5 is made of a Pt-based alloy containing 20% Ir by weight in the same component of the noble metal tip 3, and having the following particulars.

The noble metal tip 5 measures 0.5 mm in diameter and 0.2 mm in thickess when referring to the mono-gap type spark plug B.

The noble metal tip 5 measures 0.9 mm in diameter and 0.4 mm in thickess when referring to the mono-gap type spark plug C.

The noble metal tip 5 measures 0.9 mm in diameter and 0.4 mm in thickess when referring to the mono-gap type spark plug A.

A spark erosion resistance experimental test was carried out to compare the mono-gap type spark plug B (C) to a mono-gap type spark plug H in which no noble metal tip (3, 5) was provided.

The spark discharge gap and the raw material of the mono-gap type spark plug H is the same as those of mono-gap type spark plug B (C) except that no noble metal tip is provided with the mono-gap type spark plug H which has a straight type center electrode (2.5 mm in dia.).

Upon carrying out the experimental test, the spark plugs A, B, C, H were mounted on a 3000 cc, V-type six-cylinder engine with the use of dual polarity type ignition device (DLI) in a dual polarity type ignition system to run the engine at 5500 rpm×W.O.T. (full throttle condition) in the following combination.

Figure 3:
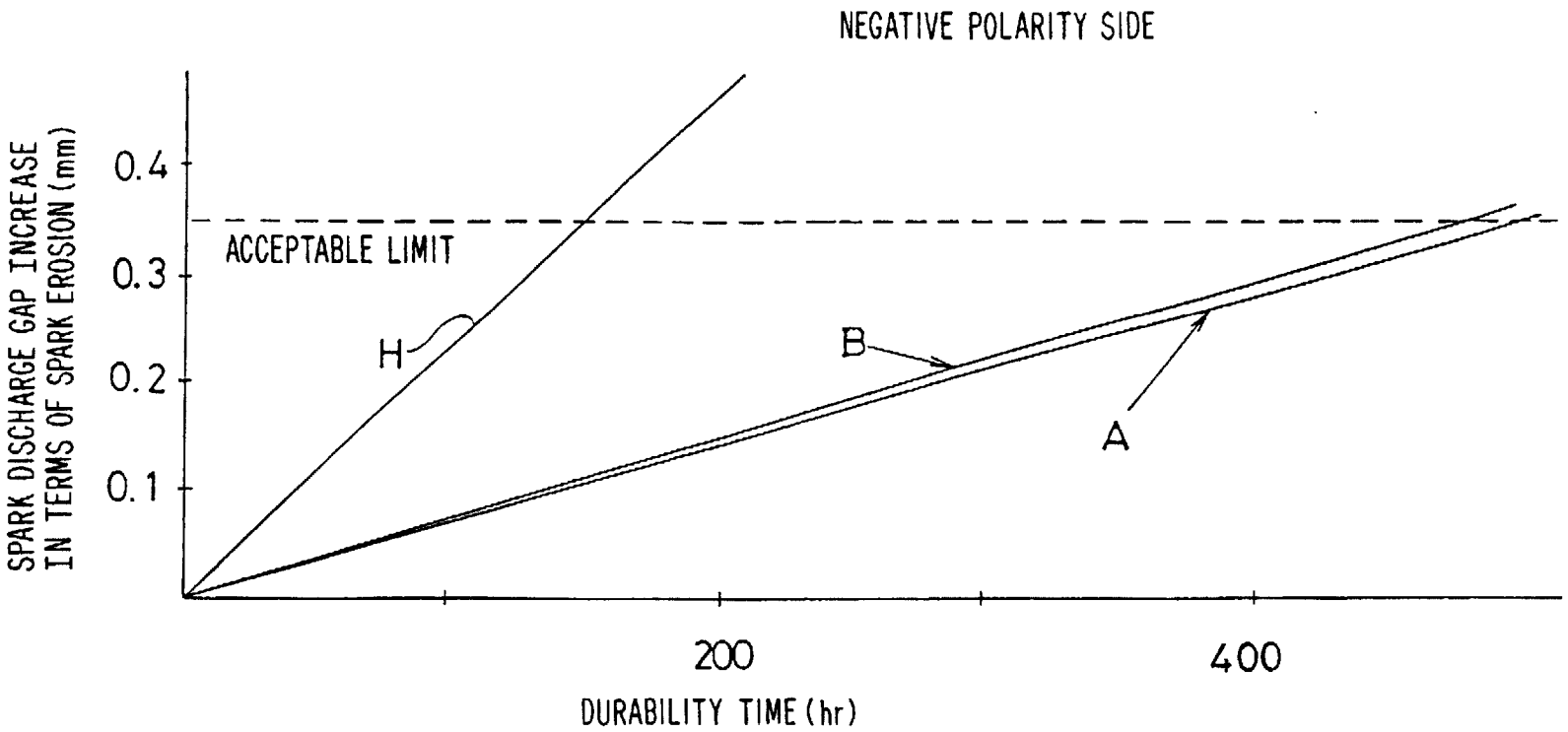
FIG. 3 is a graphical representation obtained after carrying out a spark erosion resistance experimental test with the mono-gap type spark plug in the negative polarity.

As shown in FIG. 3, no significant difference was found in the spark discharge gap increase in terms of the spark erosion speed between of the mono-gap type spark plug B (negative polarity group) in which the center electrode is in the negative polarity side and the mono-gap type spark plug A which belongs to the dual polarity group.

Figure 4:
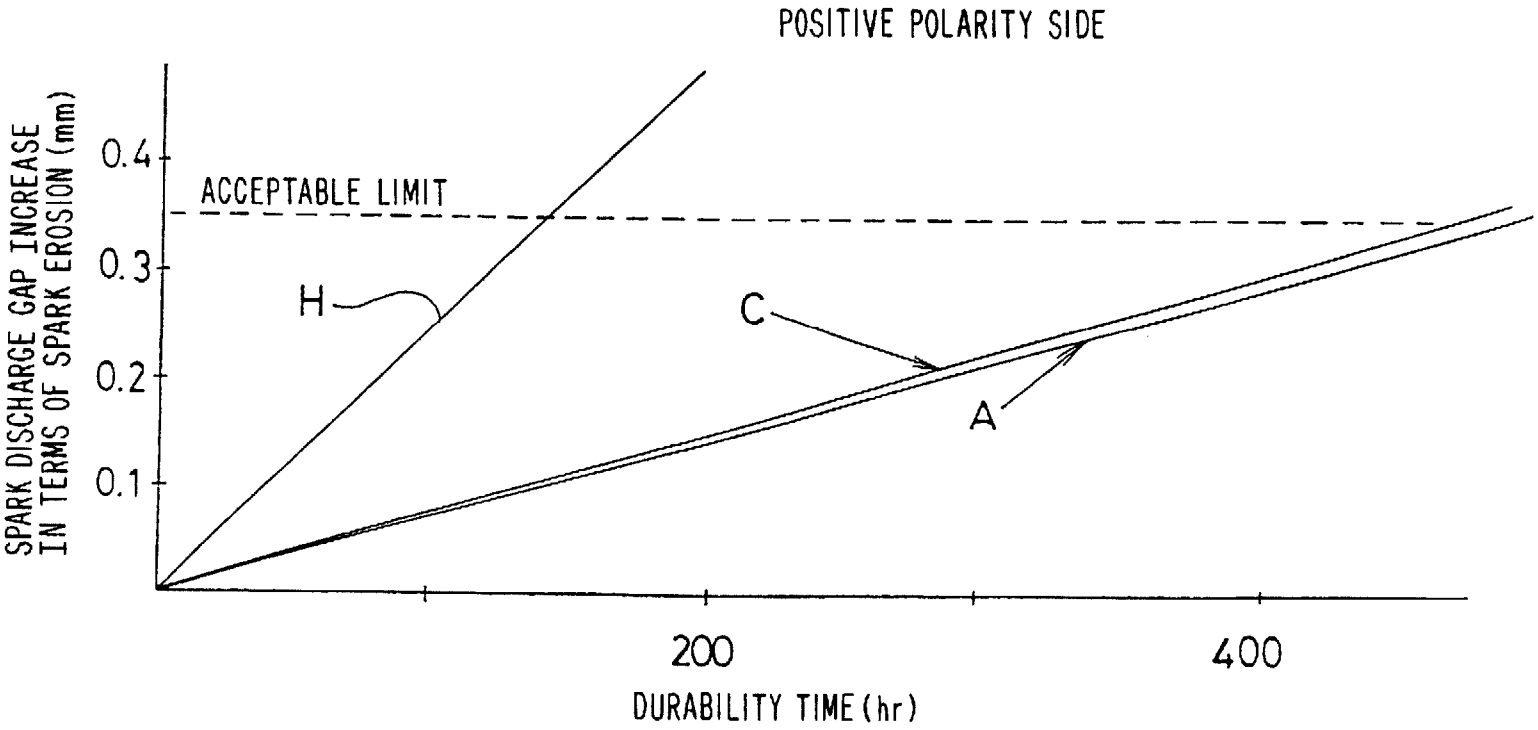
FIG. 4 is a graphical representation obtained after carrying out a spark erosion resistance experimental test with the mono-gap type spark plug in the positive polarity.

As shown in FIG. 4, likewise, no significant difference was found in the spark erosion rate between the mono-gap type spark plug C (positive polarity group) in which the center electrode is in the positive polarity side and the mono-gap type spark plug A which belongs to the dual polarity group.

Figure 5:
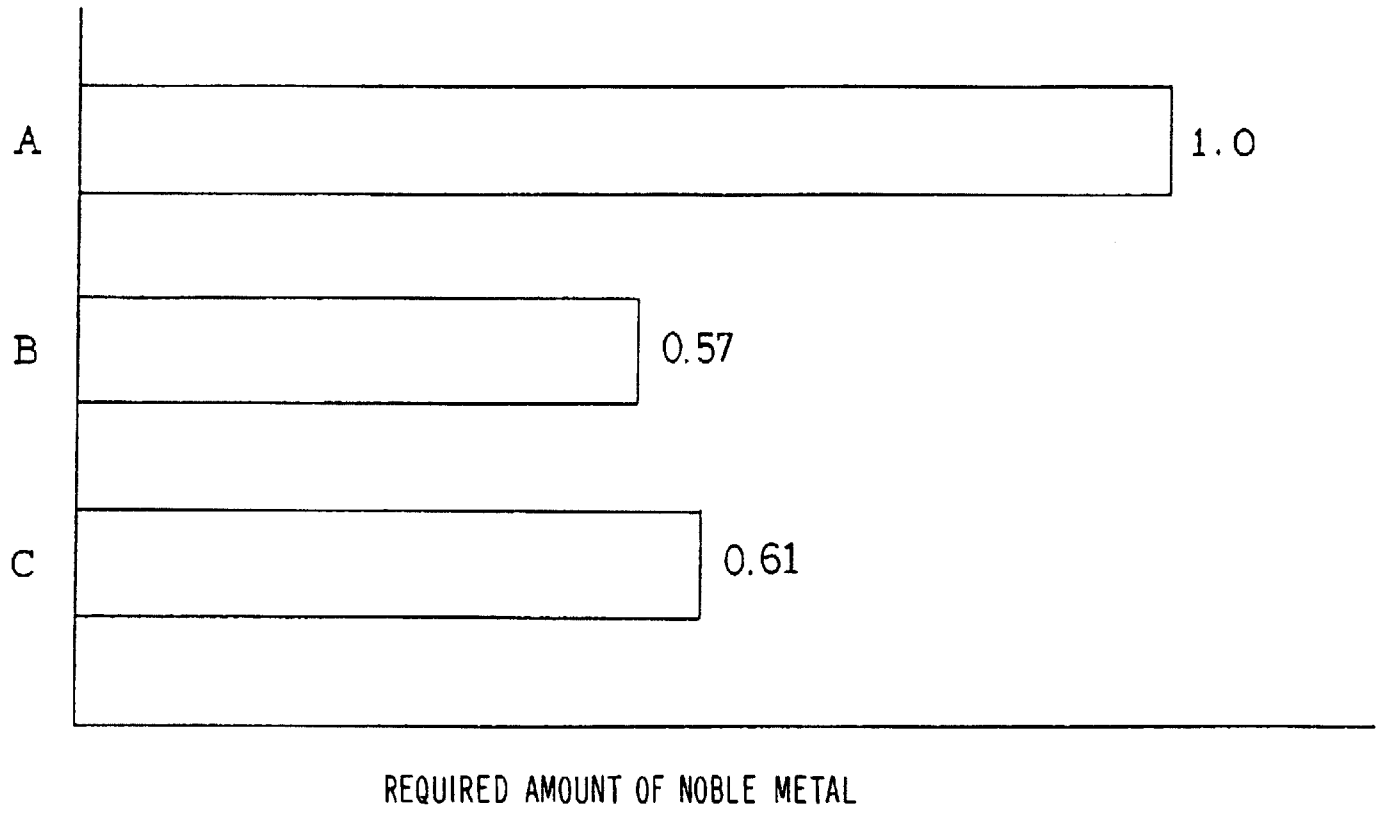
FIG. 5 is a graphical representation showing an amount of a noble metal used to each of the mono-gap type spark plugs.

FIG. 5 shows an amount of the noble metal used for each of the spark plugs A, B, C. When the amount of the noble metal used to the spark plug A is converted to 1.0, the amount of the noble metal used for the spark plugs B and C in turn comes approximately to 0.57 and 0.61.

With the adoption of the mono-gap type spark plug B in which the center electrode is in the negative side and the mono-gap type spark plug C (positive polarity group) in which the center electrode is in the positive side, it is found that the noble metal tip needs only 59.5% of the noble metal used when the mono-gap type spark plug A is uniformly adopted. This makes it possible to reduce the price of the product without losing a good spark erosion resistant property which is insured substantially when the mono-gap type spark plug A is uniformly used.

It is to be noted that it is possible to obviate the noble metal tip provided on the center electrode 4 of the mono-gap type spark plug C (positive polarity group) without losing the good spark erosion resistant property as obtained in the first embodiment of the invention.

In reference to FIGS. 1 and 2 which also depict mono-gap type spark plug B2 (C2) according to a second embodiment of the invention, the center electrode 4 in the mono-gap type spark plug B2 (negative polarity group) is in the negative polarity side, and the center electrode 4 in the mono-gap type spark plug C2 (positive polarity group) is in the positive polarity side.

With respect to particular dimensions, the spark discharge gap and the raw material of the mono-gap type spark plug B2 (C2) are the same as those of mono-gap type spark plug B (C).

The noble metal tip 3 measures 0.8 mm in diameter and 0.5 mm in thickness.

The noble metal tip 3 is made of Pt-based alloy having the following constituents.

The Pt-based alloy contains 5% nickel by weight when referring to the mono-gap type spark plug B2.

The Pt-based alloy contains 20% nickel by weight when referring to the mono-gap type spark plug C2.

The Pt-based alloy contains 5% nickel by weight when referring to the mono-gap type spark plug A2.

The noble metal tip 5 has the same material as the noble metal tip 3, and measures 0.9 mm in diameter and 0.4 mm in thickness.

The noble metal tip 5 is made of Pt-based alloy having the following constituents.

The Pt-based alloy contains 30% nickel by weight when referring to the mono-gap type spark plug B2.

The Pt-based alloy contains 10% nickel by weight when referring to the mono-gap type spark plug C2.

The Pt-based alloy contains 10% nickel by weight when referring to the mono-gap type spark plug A2.

The spark erosion resistance experimental test was carried out in the same manner as described in the first embodiment of the invention.

Upon carrying out the experimental test, the spark plugs B2, C2, A2 were mounted on a 3000 cc, V-type six-cylinder engine with the use of a dual polarity type device in a dual polarity type ignition system to run the engine at 5500 rpm×W.O.T. (full throttle condition) in the following combination.

The result shows that no significant difference was found in the spark discharge gap increase in terms of the spark erosion rate between the mono-gap type spark plug B2 in which the center electrode is in the negative polarity side and the mono-gap type spark plug A2 in which the center electrode is in the negative polarity.

The result further shows that no significant difference was found in the spark erosion rate between the mono-gap type spark plug C2 in which the center electrode is in the positive polarity side and the mono-gap type spark plug A2 in which the center electrode is in the positive polarity.

With the combinatorial use of the mono-gap type spark plug B2 (negative polarity group) in which the center electrode is in the negative side with greater amount of the noble metal component and the mono-gap type spark plug C2 (positive polarity group) in which the center electrode is in the positive side with smaller amount of the noble metal component, it is possible to reduce the amount of the noble metal compared to that required when the mono-gap type spark plug A2 is uniformly adopted. This makes it possible to reduce the price of the product without losing a good spark erosion resistant property which is obtained substantially when the mono-gap type spark plug A2 is uniformly used.

It should be noted that it is possible to omit the noble metal tip provided on the center electrode 4 of the mono-gap type spark plug C,C2 (positive polarity group) without losing the good spark erosion resistant property as achieved by the second embodiment of the invention.

Figure 8:
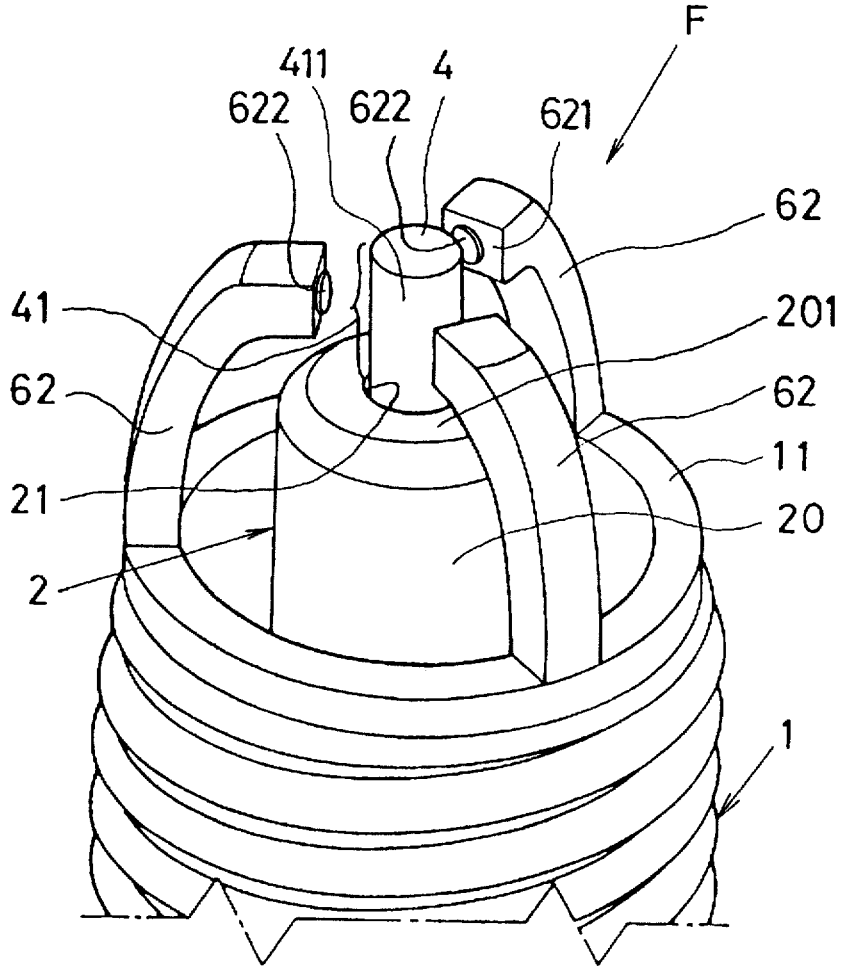
FIG. 8 is an enlarged perspective view of a front section of a multi-gap type spark plug in which a noble metal tip is provided on a ground electrode according to each of the embodiments of the present invention.

In reference to FIGS. 1, 2 and 8 which show a third embodiment of the invention, the mono-gap type spark plug B (negative polarity group) is adopted in which the center electrode 4 is in the negative side, and a multi-gap type spark plug F (positive polarity group) is adopted in which the center electrode 4 is in the positive side.

The multi-gap type spark plug F has the metal shell 1, the insulator 2 and the center electrode 4 whose front end 41 extends from the front end 201 of the insulator 2. As designated by numeral 62, three ground electrodes extend from the front end 11 of the metal shell 1. Each of the front end surfaces 621 of the ground electrodes 62 has the noble metal tip 622 which faces an elevational side 411 of the front end 41 of the center electrode 4.

The noble petal tip 622 is made of Pt-based alloy containing 20% Ir by weight, and measures 0.9 mm in diameter and 0.4 in thickness. In this Instance, the noble metal tip may be provided around the front end 41 of the center electrode 4 along its entire circumferential length.

The spark erosion resistance experimental test was carried out in the same manner as described in the first embodiment of the invention.

Upon carrying out the experimental test, the spark plugs B, F were mounted on a 3000 cc, V-type six-cylinder engine with the use of a dual polarity type device (DLI) in a dual polarity type ignition system to run the engine at 5500 rpm×W.O.T. (full throttle condition) in the following combination.

The result shows that no significant difference was found in the spark discharge gap increase in terms of the spark erosion rate between the mono-gap type spark plug B (negative polarity group) in which the center electrode is in the negative polarity side and the mono-gap type spark plug A (dual polarity group) in which the center electrode is in the negative polarity.

The result also shows that no significant difference was found in the spark erosion rate between the multi-gap type spark plug F (positive polarity group) in which the center electrode is in the positive polarity side and the mono-gap type spark plug A (dual polarity group) in which the center electrode is in the positive polarity.

With the combinatorial use of the mono-gap type spark plug B in which the center electrode is in the negative side and the multi-gap type spark plug F in which the center electrode is in the positive side, it is possible to reduce the amount of the noble metal compared to that required when the mono-gap type spark plug A is uniformly adopted. This makes it possible to reduce the price of the product without losing a good spark erosion resistance property which is achieved substantially when the mono-gap type spark plug A is uniformly used.

It should be observed that it is possible to omit the noble metal tip provided on the center electrode 4 of the multi-gap type spark plug F (positive polarity group). It is also possible to omit the noble metal tip provided on the ground electrode of the mono-gap type spark plug B (negative polarity group). It is possible to combinatorially use these two spark plugs without losing the good spark erosion resistant property as insured by the third embodiment of the invention.

Figure 6:
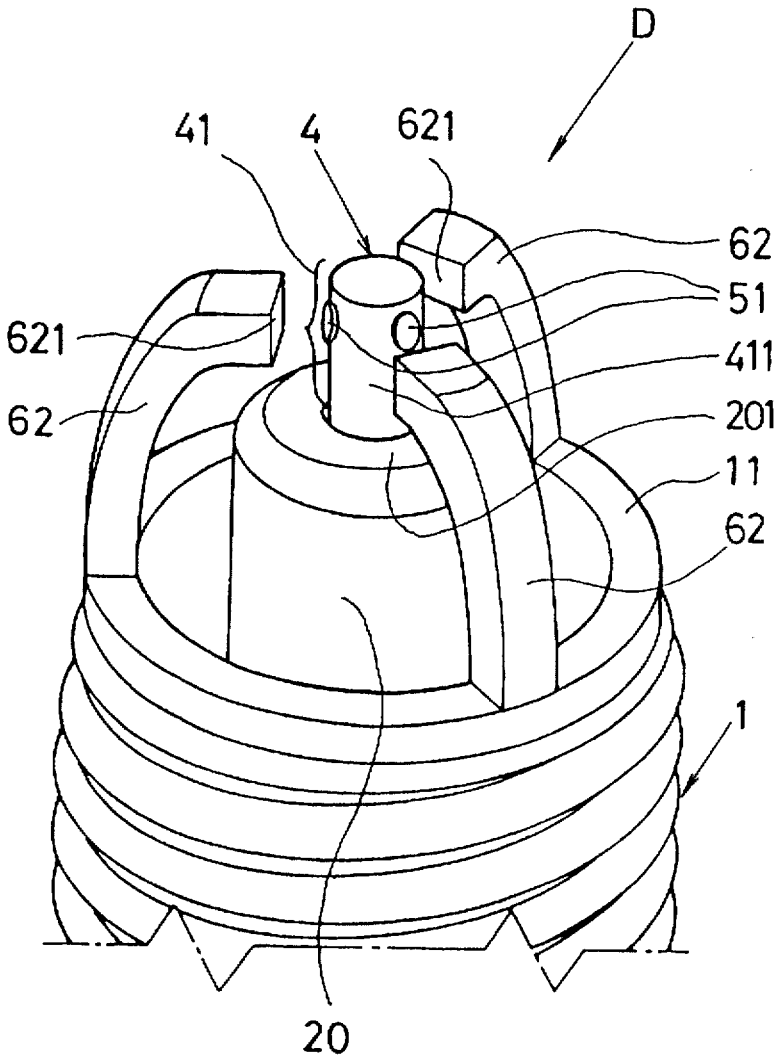
FIG. 6 is an enlarged perspective view of a front section of a multi-gap type spark plug in which a noble metal tip is provided on a center electrode according to each of the embodiments of the present invention.
Figure 7:
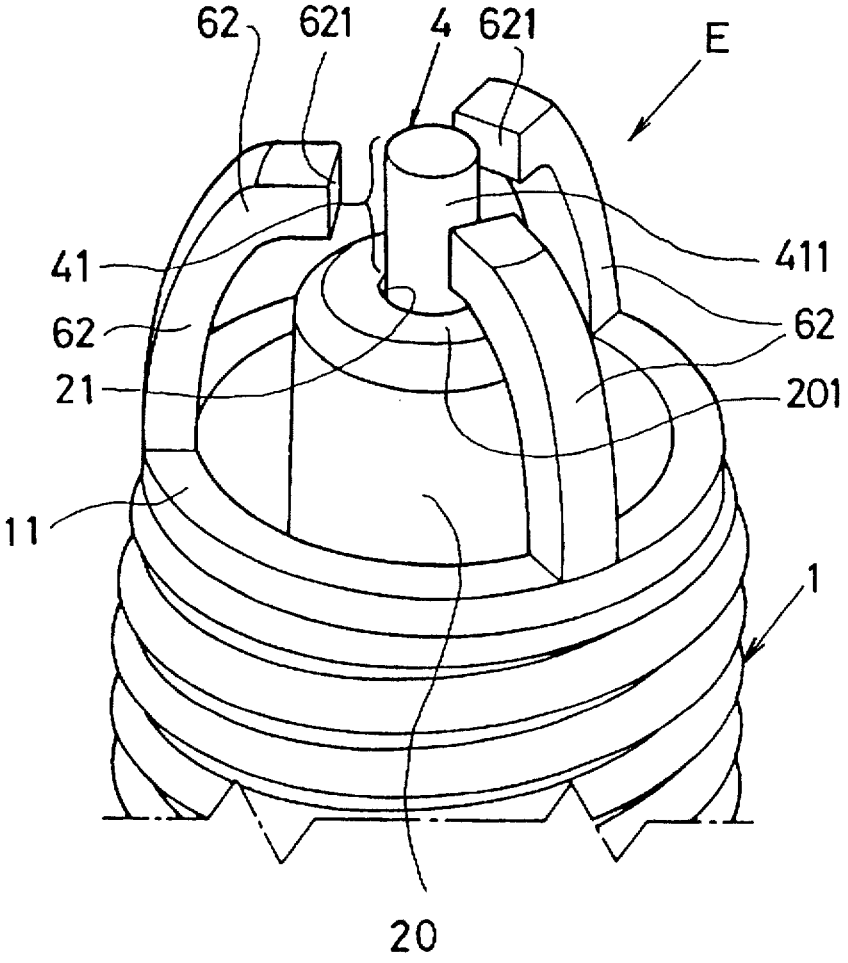
FIG. 7 is an enlarged perspective view of a front section of a multi-gap type spark plug in which no noble metal tip is provided on both electrodes according to each of the embodiments of the present invention.

In further reference to FIGS. 6, 7 which show a fourth embodiment of the invention, the multi-gap type spark plug D is adopted in which the center electrode 4 is in the negative side, and a multi-gap type spark plug E is used in which the center electrode 4 is in the positive side.

The multi-gap type spark plug E has the metal shell 1, the insulator 2 and the center electrode 4 whose front end 41 extends from the front end 201 of the insulator 2. As designated by numeral 62, three ground electrodes extend from the front end 11 of the metal shell 1 to make their front end surface 621 face an elevational side 411 of the front end 41 of the center electrode 4.

The spark erosion resistance experimental test was carried out in the same manner as described in the first embodiment of the invention.

Upon carrying out the experimental test, the multi-polarity type spark plugs D, E were mounted on a 3000 cc, six-cylinder engine with the use of a dual polarity type device (DLI) in a dual polarity type ignition system to run the engine at 5500 rpm×W.O.T. (full throttle condition) in the following combination.

The result shows that no significant difference was found in spark discharge gap increase in terms of the spark erosion rate between the multi-gap type spark plug D (negative polarity group) in which the center electrode is in the negative polarity side and a multi-gap type spark plug (not shown) in which the noble metal tip is provided on both the electrodes, and the center electrode is in the negative polarity.

The result also shows that no significant difference was found in the spark erosion rate between the multi-gap type spark plug E (positive polarity group) in which the center electrode is in the positive polarity side and the multi-gap type spark plug (not shown) in which the noble metal tip is provided on both the electrodes, and the center electrode is in the positive polarity.

With the combinatorial adoption of the multi-gap type spark plug D (negative polarity group) and multi-gap type spark plug E (positive polarity group), it is possible to reduce the amount of the noble metal compared to that required when the multi-gap type spark plug D is uniformly used to each of the cylinders of the internal combustion engine. This makes it also possible to reduce the price of the product without losing a good spark erosion resistant property which is substantially insured when the multi-gap type spark plug D is uniformly used to each of the cylinders of the internal combustion engine.

In reference to FIGS. 6, 8 which also show a fifth embodiment of the invention, the multi-gap type spark plug D (negative polarity group) is adopted in which the center electrode 4 is in the negative side, and a multi-gap type spark plug F (positive polarity group) is used in which the center electrode 4 is in the positive side. In the multi-gap type spark plug F, the noble metal tips 622 are provided on the ground electrodes instead of the center electrode of the multi-gap type spark plug D.

Reverting to FIG. 6, the multi-gap type spark plug D has the metal shell 1, the insulator 2 and the center electrode 4 whose front end 41 extends from the front end 201 of the insulator 2. The three ground electrodes 62, which extends from the front end 11 of the metal shell 1, have the front end surface 621 which faces the noble metal tip 51 provided on the elevational side 411 of the front end 41 of the center electrode 4.

The noble metal tip 622 is made of Pt-based alloy containing 20% Ir by weight, and measures 0.9 mm in diameter and 0.4 in thickness.

The spark erosion resistance experimental test was carried out in the same manner as described in the first embodiment of the invention.

Upon carrying out the experimental test, the spark plugs D, F were mounted on a 3000 cc, V-type six-cylinder engine with the use of a dual polarity type device (DLI) in a dual polarity type ignition system to run the engine at 5500 rpm×W.O.T. (full throttle condition) in the following combination.

The result shows that no significant difference was found in the spark discharge gap increase in terms of the spark erosion rate between the multi-gap type spark plug D, F (negative polarity group, positive polarity group) in which the center electrode is in the negative polarity side and a multi-gap type spark plug (not shown) in which the noble metal tip is provided on both the center electrode and the ground electrode. The same is true between the multi-gap type spark plug F (positive polarity group) and the multi-gap type spark plug (not shown) in which the noble metal tip is provided on both the center electrode and the ground electrode.

With the combinatorial use of the multi-gap type spark plug D (negative polarity group) and the multi-gap type spark plug F (positive polarity group), it is possible to reduce the amount of the noble metal compared to that required in which the multi-gap type spark plug in which the noble metal tip is provided on both the center and ground electrode. This makes it possible to reduce the price of the product without losing a good spark erosion resistance property which is insured substantially when the multi-gap type spark plug is uniformly used in which the noble metal tip is provided on both the center electrode and the ground electrode.

It is to be appreciated that the noble metal tip 622 used in the fifth embodiment of the invention may be made of Pt-Ni alloy metal as the same manner in the second embodiment of the invention. With this structure thus provided, it is possible to achieve the same effects as those mentioned in the fifth embodiment of the invention.

Figure 9:
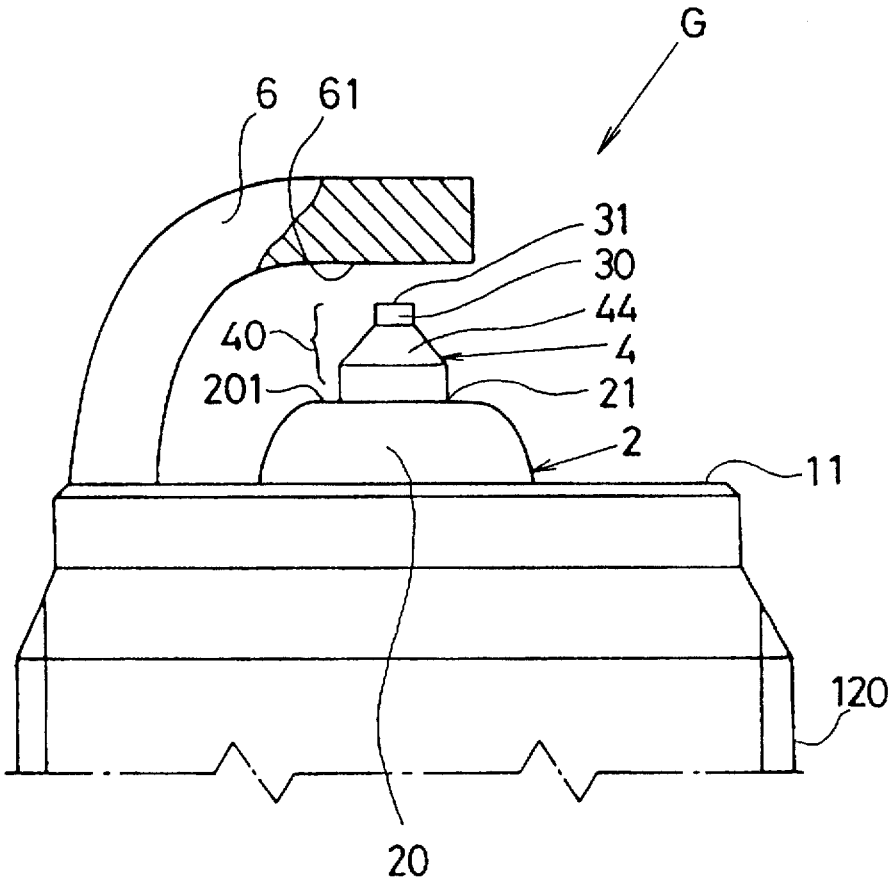
FIG. 9 is an enlarged perspective view of a front section of a mono-gap type spark plug according to a sixth embodiment of the present invention.

In reference to FIGS. 1, 9 which show a sixth embodiment of the invention, a mono-gap type spark plug G (negative polarity group) is adopted in which the center electrode 4 is in the negative side, and the mono-gap type spark plug C (positive polarity group) is used in which the center electrode 4 is in the positive side.

The mono-gap type spark plug G is structurally the same as the spark plug of FIGS. 1, 2 except that a noble metal tip 30 is provided only on the center electrode 4. The noble metal tip 30 is made of Pt-based alloy containing 20% Ir by weight, and measures 0.8 mm in diameter and 0.5 mm in thickness.

The spark erosion resistance experimental test was carried out in the same manner as described in the first embodiment of the invention.

Upon carrying out the experimental test, the spark plugs C, G were mounted on a 3000 cc, V-type six-cylinder engine with the use of a dual polarity type device (DLI) in a dual polarity type ignition system to run the engine at 5500 rpm×W.O.T. (full throttle condition) in the following combination.

The result shows that no significant difference was found in the spark discharge gap increase in terms of the spark erosion rate between the mono-gap type spark plug G (negative polarity group) in which the center electrode is in the negative polarity side and a mono-gap type spark plug C (positive polarity group) in which the center electrode is in the positive polarity.

With the combinatorial arrangement of the mono-gap type spark plug G and the mono-gap type spark plug C, it is possible to reduce the amount of the noble metal compared to that required when the mono-gap type spark plug C (alternatively A) is uniformly used to each of the cylinders of the internal combustion engine. This makes it also possible to reduce the price of the product without losing a good spark erosion resistant property which is substantially insured when the mono-gap type spark plug C is uniformly used to each of the cylinders of the internal combustion engine.

It should be observed that it is possible to replaced the noble metal tip 30 of the mono-gap type spark plug (negative polarity group) by the noble metal tip 3 provided on the center electrode of the mono-gap type spark plug B2 of the second embodiment of the invention, while at the same time, replacing the mono-gap type spark plug (positive polarity) by the mono-gap type spark plug C2 of the second embodiment of the invention. With the structure obtained above, it is possible to achieve the same effects as those mentioned in the sixth embodiment of the invention.

Figure 10:
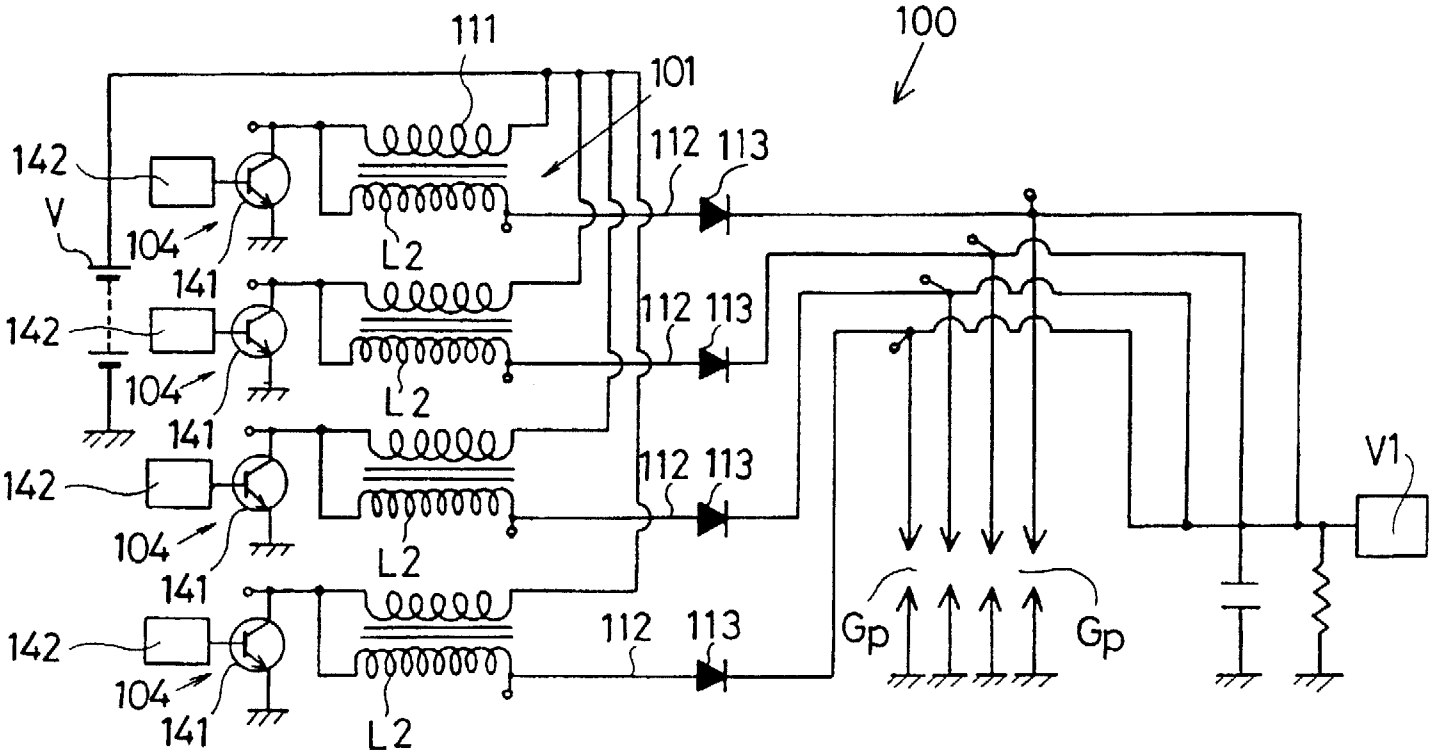
FIG. 10 is a blocking diagram of a distributorless ignition device (DLI) according to each of the embodiments of the present invention.

FIG. 10 shows one example of the distributorless ignition device (DLI) in the dual polarity type ignition system for use in a V-type four-cylinder engine. In the ignition device (DLI) as designated at 100, each of ignition coils 101 has a primary coil 111 whose one end is connected via a power source VI, and whose other end connected to an interrupter member 104 which includes a switching element 141 and a signal generator 142. From a secondary coil L2 of the ignition coil 101, a main line 112 leads through a diode 113 to the spark discharge gap Gp of the spark plug which is arranged with its polarity according to each of the aforementioned embodiments of the invention. For the purpose of convenience, the spark discharge gap is represented by the single denotation Gp regardless of whether the spark plug is mono-gap type or multi-gap type one in FIG. 10.

It is to be noted that the noble metal tip may be made of not only Pt-Ir alloy and Pt-Ni alloy but Pt-Ir-Ni alloy, Ir-Ni, alloy Pt-Pd and the like as well.

It is to be observed that in the dual polarity type ignition system, the dual polarity type DLI device can be used in which the number of the ignition coils is the same or half the number of the cylinders of the internal combustion engine.

It is further to be observed that in the dual polarity type ignition system, the spark plugs used on a half side of the V-type engine have the same polarity to categorially unify the spark plugs used on half the number of the cylinder banks of the V-type engine so as to protect assembly workers from confusing them.

While the invention has been described with reference to the specific embodiments, it is understood that this description is not to be construed in a limiting sense in as much as various modifications and additions to the specific embodiments may be made by skilled artisans without departing from the scope of the invention.

What is claimed is:

1. A dual polarity ignition system comprising:

an ignition coil to establish a high voltage in a secondary coil;

a positive polarity spark plug group in which each spark plug includes a center electrode having a first tip formed of one of a noble metal and a noble metal alloy, and a ground electrode having a second tip formed of one of a noble metal and a noble metal alloy so as to form a spark discharge gap between the first tip and the second tip, wherein a positive high voltage is applied by the secondary coil to the center electrode of each spark plug of the positive polarity spark plug group; and a negative polarity spark plug group in which each spark plug includes a center electrode having a first tip formed of one of a noble metal and a noble metal alloy, and a ground electrode having a second tip formed of one of a noble metal and a noble metal alloy so as to form a spark discharge gap between the first tip of the center electrode of the negative polarity spark plug group and the second tip of the ground electrode of the negative polarity spark plug group, wherein a negative high voltage is applied by the secondary coil to the center electrode of each spark plug of the negative polarity spark plug group;

wherein the first tip of the center electrode of the positive polarity spark plug group is dimensionally smaller than the first tip of the center electrode of the negative polarity spark plug group, and further wherein the second tip of the ground electrode of the negative polarity spark plug group is dimensionally smaller than the second tip of the ground electrode of the positive polarity spark plug group.

2. The dual polarity ignition system as claimed in claim 1, wherein the first tip of the center electrode of the positive polarity spark plug group is dimensionally smaller than the second tip of the ground electrode of the positive polarity spark plug group; and the second tip of the ground electrode of the negative polarity spark plug group is dimensionally smaller than the first tip of the center electrode of the negative polarity spark plug group.

3. A dual polarity ignition system comprising:

an ignition coil to establish a high voltage in a secondary coil, a positive polarity spark plug group in which each spark plug includes a center electrode and ground electrode, the ground electrode having a tip formed of one of a noble metal and a noble metal alloy so as to form a spark discharge gap between the center electrode and the tip, wherein a positive high voltage is applied by the secondary coil to the center electrode of each spark plug of the positive polarity spark plug group;

a negative polarity spark plug group in which each spark plug includes a center electrode having a tip formed of one of a noble metal and a noble metal alloy, and a ground electrode so as to form a spark discharge gap between the tip of the center electrode of the negative polarity spark plug group and the ground electrode of the negative polarity spark plug group, wherein a negative high voltage is applied by the secondary coil to the center electrode of each spark plug of the negative polarity spark plug group;

wherein at least one of the center electrode of the positive polarity spark plug group and the ground electrode of the negative polarity spark plug group is devoid of a tip formed of one of a noble metal and a noble metal alloy.

4. The dual polarity ignition system as claimed in claim 3, wherein the ground electrode of the negative polarity spark plug group comprises a tip formed of one of a noble metal and a noble metal alloy and which is dimensionally smaller than the tip of the ground electrode of the positive polarity spark plug group.

5. The dual polarity ignition system as claimed in claim 3, wherein the center electrode of the positive polarity spark plug group comprises a tip formed of one of a noble metal and a noble metal alloy and which is dimensionally smaller than the tip of the center electrode of the negative polarity spark plug group.

6. The dual polarity ignition system as claimed in claim 3, wherein the ground electrode of the negative polarity spark plug group comprises a tip formed of one of a noble metal and a noble metal alloy and which is dimensionally smaller than the tip of the center electrode of the negative polarity spark plug group.

7. The dual polarity ignition system as claimed in claim 3, wherein the center electrode of the positive polarity spark plug group comprises a tip formed of one of a noble metal and a noble metal alloy and which is dimensionally smaller than the tip of the ground electrode of the positive polarity spark plug group.

8. A dual polarity ignition system comprising:

an ignition coil to establish a high voltage in a secondary coil;

a positive polarity spark plug group in which each spark plug includes a center electrode having a first tip formed of one of a noble metal and a noble metal alloy, and a ground electrode having a second tip formed of one of a noble metal and a noble metal alloy so as to form a spark discharge gap between the first tip and the second tip, wherein a positive high voltage is applied by the secondary coil to the center electrode of each spark plug of the positive polarity spark plug group; and a negative polarity spark plug group in which each spark plug includes a center electrode having a first tip formed of one of a noble metal and a noble metal alloy, and a ground electrode having a second tip formed of one of a noble metal and a noble metal alloy so as to form a spark discharge gap between the first tip of the center electrode of the negative polarity spark plug group and the second tip of the ground electrode of the negative polarity spark plug group, wherein a negative high voltage is applied by the secondary coil to the center electrode of each spark plug of the negative polarity spark plug group;

wherein the first tip of the center electrode of the positive polarity spark plug group is dimensionally smaller than the second tip of the ground electrode of the positive polarity spark plug group, and further wherein the second tip of the ground electrode of the negative polarity spark plug group is dimensionally smaller than the first tip of the center electrode of the negative polarity spark plug group.

* * * * *